US011151870B2

(12) United States Patent
Xu

(10) Patent No.: US 11,151,870 B2
(45) Date of Patent: Oct. 19, 2021

(54) TRAFFIC SCHEME CONTROL METHOD AND DEVICE

(71) Applicant: BEIJING BAIDU NETCOM SCIENCE AND TECHNOLOGY CO., LTD., Beijing (CN)

(72) Inventor: Qiqi Xu, Beijing (CN)

(73) Assignee: BEIJING BAIDU NETCOM SCIENCE AND TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 17/028,892

(22) Filed: Sep. 22, 2020

(65) Prior Publication Data

US 2021/0142664 A1 May 13, 2021

(30) Foreign Application Priority Data

Nov. 13, 2019 (CN) ..... 201911111863.5

(51) Int. Cl.
*G08G 1/083* (2006.01)
*G08G 1/01* (2006.01)

(52) U.S. Cl.
CPC ..... *G08G 1/083* (2013.01); *G08G 1/0145* (2013.01)

(58) Field of Classification Search
CPC ..... G08G 1/082; G08G 1/095; G08G 1/096; G08G 1/096783; G08G 1/0116; G08G 1/083
See application file for complete search history.

(56) References Cited

U.S. PATENT DOCUMENTS

| | | | | |
|---|---|---|---|---|
| 6,850,171 | B2 | 2/2005 | Mathias | |
| 9,633,560 | B1 | 4/2017 | Gao et al. | |
| 10,210,755 | B1 * | 2/2019 | Franco | G08G 1/096716 |
| 10,354,523 | B2 | 7/2019 | Jin et al. | |
| 2020/0160701 | A1 * | 5/2020 | Mobasser | G08G 1/0145 |
| 2020/0312140 | A1 * | 10/2020 | Kurehashi | G08G 1/096 |
| 2020/0410855 | A1 * | 12/2020 | Zalila-Wenkstern | G08G 1/08 |

FOREIGN PATENT DOCUMENTS

CN 109509357 A 3/2019

OTHER PUBLICATIONS

European Patent Application No. 20207205.4 extended Search and Opinion dated Apr. 14, 2021, 10 pages.

* cited by examiner

*Primary Examiner* — Mirza F Alam
(74) *Attorney, Agent, or Firm* — Lathrop GPM LLP

(57) ABSTRACT

The present disclosure provides a traffic scheme control method and device. The method includes: obtaining green light waste time of each lane in each flow direction at a traffic intersection during a green light time period; obtaining a class saturation of each lane, and obtaining a class saturation of each flow direction according to the class saturation of each lane; obtaining a class saturation of a current control scheme based on the class saturation of each group of flow directions in the current control scheme; determining a class saturation of each candidate control scheme; and determining a target control scheme having a minimum class saturation, and when the class saturation of the current control scheme is greater than the minimum class saturation, controlling a signal controller to control a next traffic cycle at the traffic intersection according to the target control scheme.

15 Claims, 3 Drawing Sheets

TRAFFIC SCHEME CONTROL METHOD AND DEVICE

CROSS-REFERENCE TO RELATED APPLICATION

This application claims priority to and benefits of Chinese Patent Application Serial No. 201911111863.5, filed the State Intellectual Property Office of P. R. China on Nov. 13, 2019, the entire content of which is incorporated herein by reference.

TECHNICAL FIELD

The present disclosure relates to a field of intelligent traffic technology, and more particularly, to a traffic scheme control method and a traffic scheme control device.

BACKGROUND

With the increase in the number of vehicles owned by users, it is important to ensure smooth traffic flow. Generally, traffic is controlled by traffic light signal control performed by an annunciator to regulate traffic pressure.

In the related art, during controlling the signal lights, a plurality of signal control schemes are stored in an annunciator at the intersection in advance, and each signal control scheme corresponds to one time period. In each period of time, the signal lights are controlled according to a signal control scheme corresponding to the period of time.

SUMMARY

Embodiments of the present disclosure provide a traffic scheme control method. The method includes:

obtaining green light waste time of each lane in each flow direction at a traffic intersection during a green light time period;

obtaining a class saturation of each lane according to the green light waste time of each lane and the green light time period of a corresponding flow direction, and obtaining a class saturation of each flow direction according to the class saturation of each lane;

obtaining a class saturation of each group of flow directions in a current control scheme of a signal controller according to the class saturation of each flow direction, and obtaining a class saturation of the current control scheme according to the class saturation of each group of flow directions in the current control scheme;

determining a class saturation of each candidate control scheme according to the class saturation of each group of flow directions, a green light time period of each group of flow directions in a plurality of candidate control schemes pre-stored in the signal controller, and a green light time period of each group of flow directions in the current control scheme; and determining a target control scheme having a minimum class saturation according to the class saturation of each candidate control scheme, and comparing the class saturation of the current control scheme with the minimum class saturation, when the class saturation of the current control scheme is greater than the minimum class saturation, controlling the signal controller to control a next traffic cycle at the traffic intersection according to the target control scheme.

Embodiments of the present disclosure provide an electronic device. The device includes: at least one processor; and a memory connected in communication with the at least one processor. The memory has instructions executable by the at least one processor stored thereon, when the instructions are executed by the at least one processor, causing the at least one processor to implement the traffic scheme control method according to the above embodiments.

Embodiments of the present disclosure provide a non-transitory computer-readable storage medium having computer instructions stored thereon. When the computer instructions are executed, the computer is caused to implement the traffic scheme control method according to the above embodiments.

Additional effects of the foregoing optional manners will be described below with reference to specific embodiments.

BRIEF DESCRIPTION OF THE DRAWINGS

The drawings are provided to better understand the solution, and do not constitute a limitation on the present disclosure, in which.

DETAILED DESCRIPTION

Exemplary embodiments of the present disclosure are described below with reference to the accompanying drawings, which include various details of the embodiments of the present disclosure to facilitate understanding, and should be considered as merely exemplary. Therefore, those skilled in the art should recognize that various changes and modifications may be made to the embodiments described herein without departing from the scope and spirit of the present disclosure. Also, for clarity and conciseness, descriptions of well-known functions and structures are omitted in the following description.

A traffic scheme control method and a traffic scheme control device are described below with reference to accompanying drawings.

In order to solve the problem caused by determining how to select a signal control scheme in an annunciator as a signal control scheme adopted in a certain period of time based on the time of period in the related art, in this solution, an evaluation system based on the green light waste time and secondary parking is established, the scheme with the highest score is selected for distribution. It is verified that the method improves the efficiency by more than 20% compared to the conventional optimization scheme.

Figure 1:
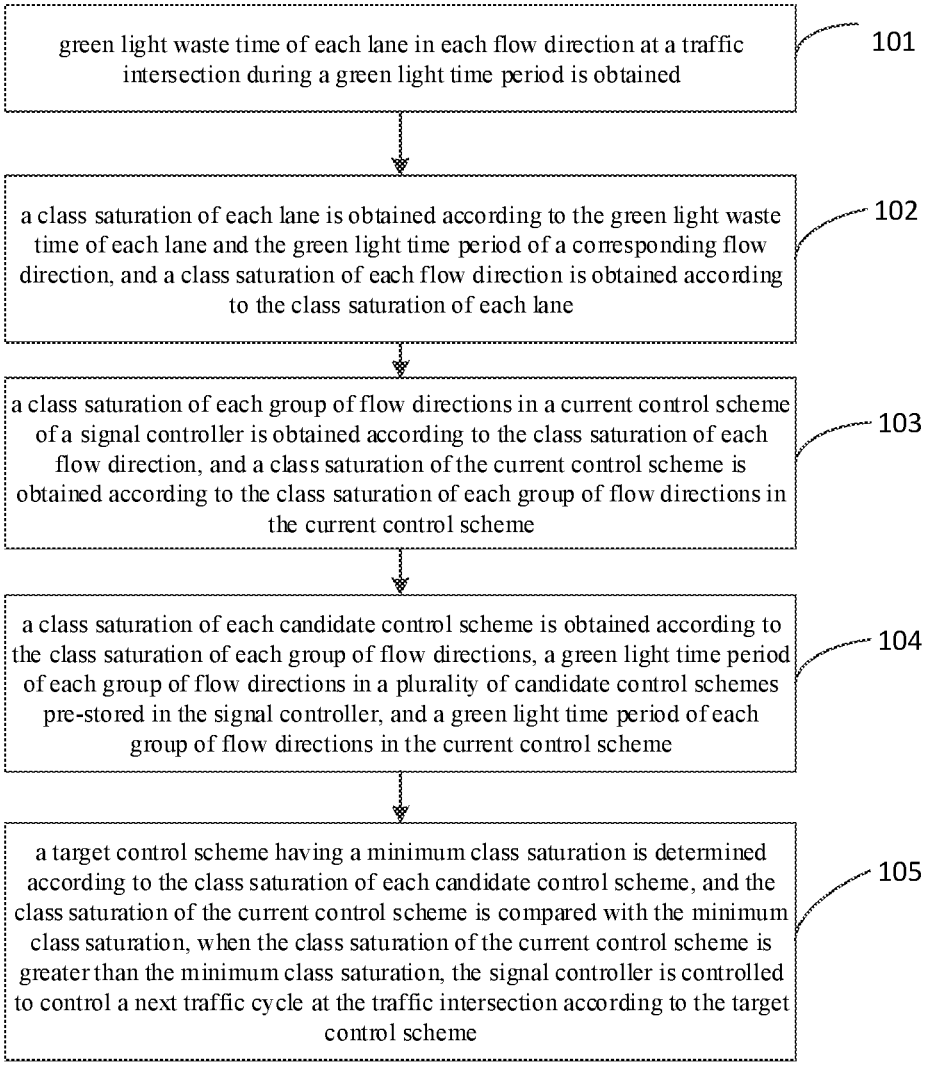
FIG. 1 is a flowchart of a traffic scheme control method according to an embodiment of the present disclosure.

In detail, FIG. 1 is a flowchart of a traffic scheme control method according to and embodiment of the present disclosure.

As illustrated in FIG. 1, the method includes the following actions.

At block 101, green light waste time of each lane in each flow direction at a traffic intersection during a green light time period is obtained.

It is understood that there is a normal safety distance between vehicles, which is defined as a saturated distance. Due to different driving habits of drivers, this normal safety distance may become larger. The travel time corresponding to a distance between an actual parking position of the vehicle and the safety distance is defined as the waste time.

In detail, the green light waste time of each lane in each flow direction at the traffic intersection during the green light time period is obtained. The waste time is closely related to the general travel of a vehicle, thus the subsequent signal control scheme is determined based on the waste time below.

As a possible implementation, a video stream during the green light time period is obtained, actual distances between vehicles are obtained according to projections of vehicles in the video. The green light waste time between vehicles is obtained according to the actual distances and the preset safety distance, and the final green light waste time is calculated according to all the green light waste time in a corresponding flow direction. For example, a distance difference between the actual distance and the safety distance is calculated, for example, the actual distance minus the safety distance, and the green light waste time is calculated based on the distance difference and a starting speed corresponding to a vehicle type of the vehicle. For another example, the distance difference between the actual distance and the safety distance is calculated, and the green light waste time is calculated based on the distance difference and a default starting speed.

Certainly, when calculating the green light waste time, vehicle image features may be identified based on image features of images in the video, the vehicle type is identified based on the vehicle image features, and the safety distance corresponding to each vehicle can be calculated according to the vehicle type.

For example, the vehicle following situation on the current road includes small vehicle following small vehicle SP1, large vehicle following large vehicle SP2, small vehicle following large vehicle SP3, and large vehicle following small vehicle SP4. The green light waste time GW=Σ(RTi−STi). RT represents a time difference between a time point when rear of a preceding vehicle passes a stop line and a time point when front of a following vehicle passes the stop line during the green light time period, and an RT corresponding to the last vehicle is a time difference between a time point when rear of the last vehicle passes the stop line and an end of the green light time period, and ST represents a time slot, i.e., a time difference between a time point when the rear of a preceding vehicle passes the stop line and a time point when the front of a following vehicle passes the stop line under a saturated inter-vehicle time (i.e., a saturation time headway) condition. It is understood that, in actual applications, when the green light is on, as the number of passing vehicles increases, the inter-vehicle time between vehicles gradually ranges from great differences to stableness. The stable inter-vehicle time is defined as the saturated inter-vehicle time. In addition, i is a serial number of a vehicle.

Figure 2:
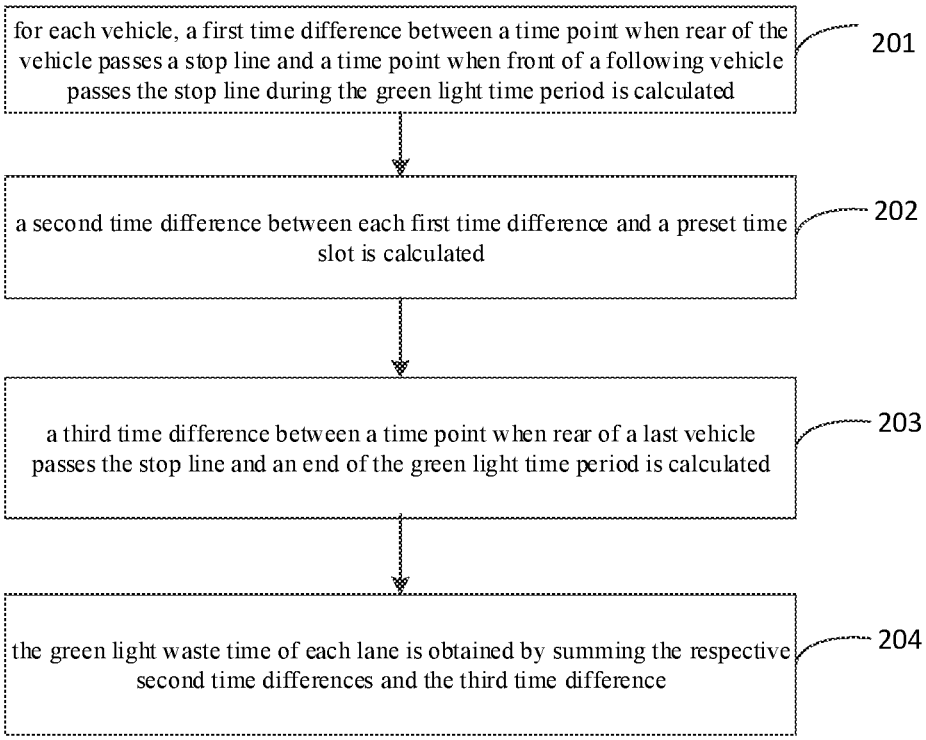
FIG. 2 is a flowchart of a traffic scheme control method according to an embodiment of the present disclosure.

In an embodiment, as illustrated in FIG. 2, the above action at block 101 includes the following.

At block 201, for each vehicle, a first time difference between a time point when rear of the vehicle passes a stop line and a time point when front of a following vehicle passes the stop line during the green light time period is calculated.

In detail, for each vehicle, the first time difference between the time point when the rear of the vehicle (defined as a preceding vehicle) passes the stop line and the time point when the front of the following vehicle (a vehicle following the preceding vehicle) passes the stop line during the green light time period is determined. That the rear of the preceding vehicle passes the stop line and the front of the following vehicle passes the stop line can be determined by a detector arranged under the stop line or can be identified from video images.

At block 202, a second time difference between each first time difference and a preset time slot is calculated.

The preset time slot may be understood as a time period required for a vehicle to pass the preset safety distance (the above-mentioned safety distance), and the second time difference between each first time difference and the preset time slot is calculated.

Certainly, as analyzed above, the safety distances corresponding to different vehicle types may be different, so the time slots corresponding to the respective vehicle types are also different. Therefore, a vehicle type group of the preceding vehicle and the following vehicle can be identified, for example, as a type of a small vehicle following a large vehicle, or a type of a truck following another truck, and the like. According to the preset time slot corresponding to the vehicle type group, the corresponding time slot can be learned and saved according to the vehicle type group in advance, and the time slot corresponding to a current vehicle type group can be obtained according to the saved information.

At block 203, a third time difference between a time point when rear of a last vehicle passes the stop line and an end of the green light time period is calculated.

Since there is no vehicle following the last vehicle, the third time difference between the time point when the rear of the last vehicle passes the stop line and the end of the green light time is calculated.

At block 204, the green light waste time of each lane is obtained by summing the respective second time differences and the third time difference.

In detail, the second time difference and the third time difference are obviously waste time relative to a normal slot (i.e., the normal safety distance), and therefore, all the second time differences and the third time difference are summed to obtain the green light waste time of each lane.

At block 102, a class saturation of each lane is obtained according to the green light waste time of each lane and the green light time period of a corresponding flow direction, and a class saturation of each flow direction is obtained according to the class saturation of each lane.

The class saturation refers to a ratio of time effectively used by the traffic flow to the green light time period, that is, a ratio of a difference between the green light time period $t_G$ minus and the green light waste time $t_W$ to the green light time period, which can be calculated by the following formula (1). The higher the class saturation value, the higher the utilization rate of the green light time period.

$$DS = \frac{t_G - t_W}{t_G} \tag{1}$$

In detail, the class saturation of each lane is obtained according to the green light waste time of each lane and the green light time period of the corresponding flow direction, and the class saturation of each flow direction is obtained according to the class saturation of each lane.

It is noted that, in different application scenarios, the way to obtain the class saturation of each flow direction according to the class saturation of each lane is different.

As a possible implementation, the class saturations of all the lanes in one flow direction are obtained, a maximum value of the class saturations is determined as the class saturation of the corresponding flow direction. That is, the maximum value of the class saturations of the lane level is taken as the class saturation of a corresponding flow direction, thereby ensuring that the class saturation of the corresponding flow direction reflects the class saturation of a lane that has the most efficient use of time in its corresponding lanes.

As another possible implementation, the class saturations of all lanes in one flow direction are obtained, and an average value of the class saturations is determined as the class saturation of the corresponding flow direction.

As another possible implementation, the class saturations of all lanes in one flow direction are obtained, a weight of each lane is determined according to factors such as traffic volume of each lane, a product value of each class saturation and its corresponding weight is calculated, and an arithmetic average value of the product values of all lanes is taken as the class saturation of the corresponding flow direction.

At block 103, a class saturation of each group of flow directions in a current control scheme of a signal controller is obtained according to the class saturation of each flow direction, and a class saturation of the current control scheme is obtained according to the class saturation of each group of flow directions in the current control scheme.

The signal controller divides the traffic flow direction of the lane into different groups by the green light, and each group is regarded as a stage of flow directions. For example, a southward straight flow direction and a northward straight flow direction are divided into one stage of flow directions. Each control scheme includes a plurality of groups of flow directions, and different control schemes include the same group of flow directions.

In detail, after obtaining the class saturation of each flow direction, the class saturation of each group of flow directions in the current control scheme of the signal controller is obtained according to the class saturation of each flow direction, and the class saturation of the current control scheme is obtained according to the class saturation of each group of flow directions in the current control scheme.

As a possible implementation, after obtaining the class saturation of each flow direction, a sum of the class saturations of each group of flow directions in the current control scheme can be used as the class saturation of a corresponding group. Alternatively, a difference between the class saturations of each group of flow directions in the current control scheme can be used as the class saturation of a corresponding group. Similarly, the class saturation of the current control scheme can be obtained according to the class saturation of each group of flow directions in the current control scheme.

At block 104, a class saturation of each candidate control scheme is obtained according to the class saturation of each group of flow directions, a green light time period of each group of flow directions in a plurality of candidate control schemes pre-stored in the signal controller, and a green light time period of each group of flow directions in the current control scheme.

In detail, as analyzed above, each group of flow directions corresponds to a different green light time period. In essence, the green light time period of the signal controller is adjusted. Therefore, the class saturation of each candidate control scheme is calculated by combining the class saturation of each group of flow directions, the green light time period of each group of flow directions in the plurality of candidate control schemes pre-stored in the signal controller, and the green light time period of each group of flow directions in the current control scheme, to screen out a suitable control scheme based on the class saturation of each candidate scheme.

Figure 3:
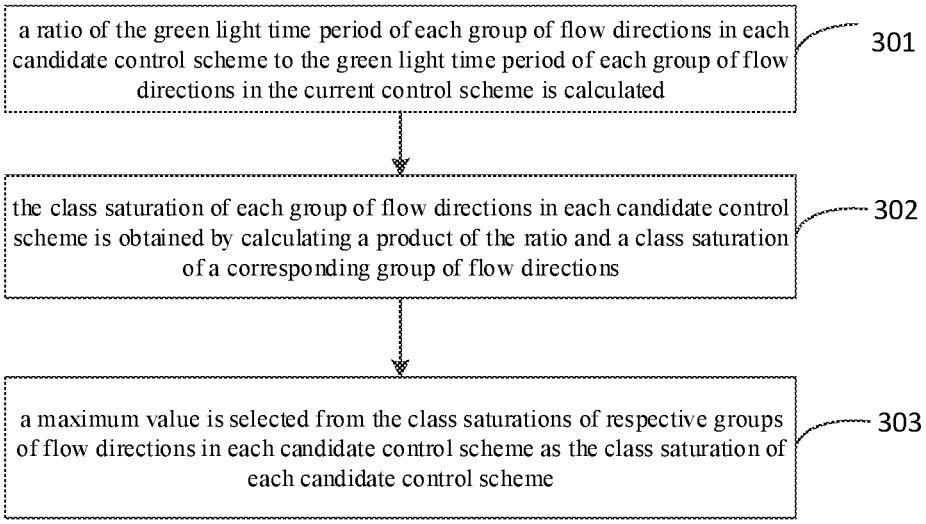
FIG. 3 is a flowchart of a traffic scheme control method according to an embodiment of the present disclosure.

As a possible implementation, as illustrated in FIG. 3, the above action 104 includes the following.

At block 301, a ratio of the green light time period of each group of flow directions in each candidate control scheme to the green light time period of each group of flow directions in the current control scheme is calculated.

It is understood that each group of flow directions is controlled based on the green light time period. Therefore, the ratio of the green light time period of each group of flow directions in each candidate control scheme to the green light time period of each group of flow directions in the current control scheme is calculated in order to select the appropriate control scheme based on the ratio.

At block 302, the class saturation of each group of flow directions in each candidate control scheme is obtained by calculating a product of the ratio and a class saturation of a corresponding group of flow directions.

In detail, the class saturation of each group of flow directions in each candidate control scheme is obtained by calculating the product of the ratio and the class saturation of the corresponding group of flow directions, and the green light time period and the class saturation of the corresponding group of flow directions are comprehensively considered to calculate the class saturation of each group of flow directions in each candidate control scheme.

At block 303, a maximum value is selected from the class saturations of respective groups of flow directions in each candidate control scheme as the class saturation of each candidate control scheme.

In detail, the maximum value is selected from the class saturations of respective groups of flow directions in each candidate control scheme as the class saturation of the corresponding candidate control scheme. Since the class saturation of the flow direction is determined by the class saturation of the lane level, and the class saturation of each scheme is determined by the class saturations of the respective flow directions. Therefore, by selecting the maximum value of the class saturations of the respective groups of flow directions, the next cycle can be controlled according to the scheme with a higher green light time utilization rate, thereby ensuring more vehicles to pass the intersection.

For example, each candidate control scheme and the current control scheme include A, B, and C groups of flow directions. The groups of flow directions in each candidate control scheme corresponds to a different green light time period. In the current control scheme, the class saturation of A group of flow directions is 90%, the class-saturation of B group of flow directions is 80%, and the class saturation of C group of flow directions is 70%. Thus, the corresponding class saturation DS is calculated according to the ratio of the green light time periods of the same group of flow directions in different schemes. For example, the green light time period of A group of flow directions in the candidate control scheme 1 is 20s, and the green light time period of A group of flow directions in the current control scheme is 30s. Then, the class saturation of A group of flow directions in the control scheme 1 is calculated as 20/30*90%=60%. In this calculation method, the product of the ratio and the class saturation of the corresponding group of flow directions is calculated to obtain the class saturation of each group of flow directions in each candidate control scheme. The maximum value of the class saturations of the respective groups of flow directions in each candidate control scheme is selected as the class saturation of each candidate control scheme. Finally, the class saturation of the candidate control scheme 1 is 60%, the class saturation of the candidate control scheme 5 is 50%, the class saturation of the candidate control scheme 3 is 95%, and the class saturation of the current control scheme is 90%. Obviously, the candidate control scheme 2 corresponding to the smallest class saturation (i.e., 50%) is the most effective control scheme, and the signal controller is controlled to control the next traffic cycle of the traffic intersection according to the candidate control scheme 2.

At block 105, a target control scheme having a minimum class saturation is determined according to the class saturation of each candidate control scheme, and the class saturation of the current control scheme is compared with the minimum class saturation, when the class saturation of the current control scheme is greater than the minimum class saturation, the signal controller is controlled to control a next traffic cycle at the traffic intersection according to the target control scheme.

In detail, the target control scheme corresponding to the minimum class saturation is determined according to the class saturation of each candidate control scheme, and the class saturation of the current control scheme is compared with the minimum class saturation. When the class saturation of the current control scheme is greater than the minimum class saturation, it indicates that the target control scheme is obviously better than the current control scheme for the current driving situation. Therefore, the signal controller controls the next traffic cycle of the traffic intersection according to the target control scheme.

In an embodiment of the present disclosure, when the class saturation of the current control scheme is less than or equal to the minimum class saturation, it indicates that the current control scheme is obviously better than the target control scheme for the current driving situation. Therefore, the signal controller controls the next traffic cycle of the traffic intersection according to the current control scheme.

In conclusion, with the traffic scheme control method according to embodiment of the present disclosure, the green light waste time of each lane in each flow direction at the traffic intersection during the green light time period is obtained. The class saturation of each lane is obtained according to the green light waste time of each lane and the green light time period of a corresponding flow direction, and the class saturation of each flow direction is obtained according to the class saturation of each lane. Moreover, the class saturation of each group of flow directions in the current control scheme of a signal controller is obtained according to the class saturation of each flow direction, and the class saturation of the current control scheme is obtained according to the class saturation of each group of flow directions in of the current control scheme. The class saturation of each candidate control scheme is calculated according to the class saturation of each group of flow directions, the green light time period of each group of flow directions in the plurality of candidate control schemes pre-stored in the signal controller, and the green light time period of each group of flow directions in the current control scheme. Finally, the target control scheme having the minimum class saturation is determined according to the class saturation of each candidate control scheme, and the class saturation of the current control scheme is compared with the minimum class saturation, when the class saturation of the current control scheme is greater than the minimum class saturation, the signal controller is controlled to control the next traffic cycle at the traffic intersection according to the target control scheme. Therefore, an evaluation system based on the green light waste time and secondary parking is established, and an optimal control scheme is selected for distribution, which ensures the rationality of the signal control scheme adopted and improves the traffic patency.

Figure 4:
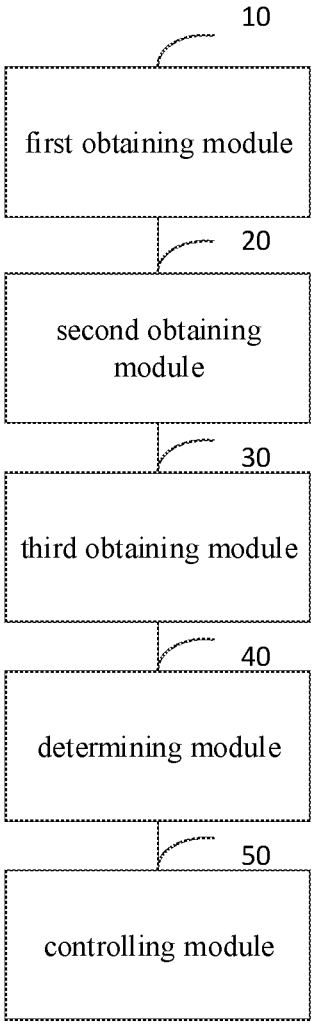
FIG. 4 is a schematic diagram of a traffic scheme control device according to an embodiment of the present disclosure.

In order to implement the above embodiments, the present disclosure further provides a traffic scheme control device. FIG. 4 is a schematic diagram of a traffic scheme control device according to an embodiment of the present disclosure. As illustrated in FIG. 4, the traffic scheme control device includes: a first obtaining module 10, a second obtaining module 20, a third obtaining module 30, a determining module 40, and a controlling module 50.

The first obtaining module 10 is configured to obtain green light waste time of each lane at a traffic intersection in each flow direction during a green light time period.

The second obtaining module 20 is configured to obtain a class saturation of each lane according to the green light waste time of each lane and the green light time period of a corresponding flow direction, and to obtain a class saturation of each flow direction according to the class saturation of each lane.

The third obtaining module 30 is configured to obtain a class saturation of each group of flow directions in a current control scheme of a signal controller according to the class saturation of each flow direction, and obtain a class saturation of the current control scheme according to the class saturation of each group of flow directions in the current control scheme.

The determining module 40 is configured to determine a class saturation of each candidate control scheme according to the class saturation of each group of flow directions, a green light time period of each group of flow directions in a plurality of candidate control schemes pre-stored in the signal controller, and a green light time period of each group of flow directions at each stage in the current control scheme. The controlling module 50 is configured to determine a target control scheme having a minimum class saturation according to the class saturation of each candidate control scheme, and compare the class saturation of the current control scheme with the minimum class saturation, when the class saturation of the current control scheme is greater than the minimum class saturation, control the signal controller to control a next traffic cycle at the traffic intersection according to the target control scheme.

In an embodiment of the present disclosure, the controlling module 50 is further configured to control the signal controller to control the next traffic cycle at the traffic intersection according to the current control scheme when the class saturation of the current control scheme is less than or equal to the minimum class saturation.

In an embodiment of the present disclosure, the first obtaining module 10 is further configured to: for each vehicle, determine a first time difference between a time point when rear of the first vehicle passes a stop line and a time point when front of a following vehicle passes the stop line during the green light time period; determine a second time difference between each first time difference and a preset time slot; determine a third time difference between a time point when rear of a last vehicle passes the stop line and an end of the green light time period; and obtain the green light waste time of each lane by summing the respective second time differences and the third time difference.

In an embodiment of the present disclosure, the first obtaining module 10 is further configured to: identify a vehicle type group of the first vehicle and the second vehicle; and obtain the preset time slot corresponding to the vehicle type group.

In an embodiment of the present disclosure, the determining module 40 is further configured to: determine a ratio of the green light time period of each group of flow direction directions in each candidate control scheme to the green light time period of each group of flow directions in the current control scheme; obtain the class saturation of each group of flow directions in each candidate control scheme by calculating a product of the ratio and a class saturation of a corresponding group of flow directions; and selecting a maximum value from the class saturations of respective groups of flow directions in each candidate control scheme as the class saturation of each candidate control scheme.

It is noted that the foregoing explanation of the traffic scheme control method is also applicable for the traffic scheme control device according to the embodiment of the present disclosure, and the implementation principles thereof are similar, and details are not described herein again.

In conclusion, with the traffic scheme control device according to embodiment of the present disclosure, the green light waste time of each lane in each flow direction at the traffic intersection during the green light time period is obtained. The class saturation of each lane is obtained according to the green light waste time of each lane and the green light time period of a corresponding flow direction, and the class saturation of each flow direction is obtained according to the class saturation of each lane. Moreover, the class saturation of each group of flow directions in the current control scheme of a signal controller is obtained according to the class saturation of each flow direction, and the class saturation of the current control scheme is obtained according to the class saturation of each group of flow directions in of the current control scheme. The class saturation of each candidate control scheme is calculated according to the class saturation of each group of flow directions, the green light time period of each group of flow directions in the plurality of candidate control schemes pre-stored in the signal controller, and the green light time period of each group of flow directions in the current control scheme. Finally, the target control scheme having the minimum class saturation is determined according to the class saturation of each candidate control scheme, and the class saturation of the current control scheme is compared with the minimum class saturation, when the class saturation of the current control scheme is greater than the minimum class saturation, the signal controller is controlled to control the next traffic cycle at the traffic intersection according to the target control scheme. Therefore, an evaluation system based on the green light waste time and secondary parking is established, and an optimal control scheme is selected for distribution, which ensures the rationality of the signal control scheme adopted and improves the traffic patency.

According to embodiments of the present disclosure, the present disclosure further provides an electronic device and a readable storage media.

Figure 5:
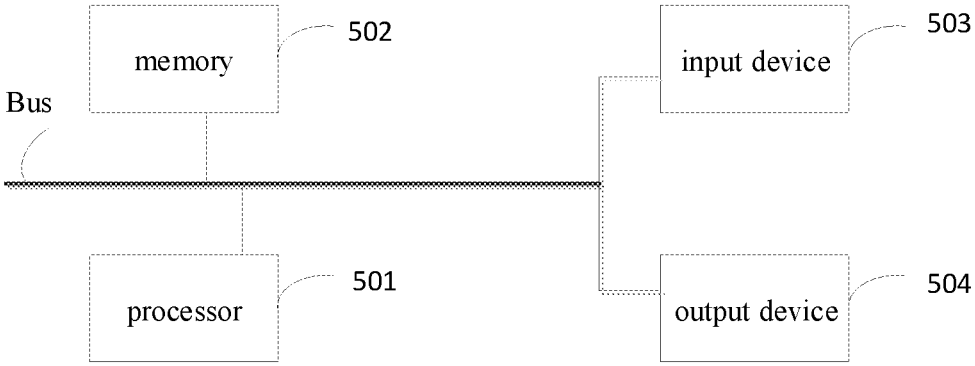
FIG. 5 is a block diagram of an electronic device for implementing a traffic scheme control method according to an embodiment of the present disclosure.

FIG. 5 is a block diagram of an electronic device for implementing the traffic scheme control method according to an embodiment of the present disclosure. Electronic devices are intended to represent various forms of digital computers, such as laptop computers, desktop computers, workbenches, personal digital assistants, servers, blade servers, mainframe computers, and other suitable computers. Electronic devices may also represent various forms of mobile devices, such as personal digital processing, cellular phones, smart phones, wearable devices, and other similar computing devices. The components shown here, their connections and relations, and their functions are merely examples, and are not intended to limit the implementation of the disclosure described and/or required herein.

As illustrated in FIG. 5, the electronic device includes: one or more processors 501, a memory 502, and interfaces for connecting various components, including a high-speed interface and a low-speed interface. The various components are interconnected using different buses and can be mounted on a common mainboard or otherwise installed as required. The processor may process instructions executed within the electronic device, including instructions stored in or on the memory to display graphical information of the GUI on an external input/output device such as a display device coupled to the interface. In other embodiments, a plurality of processors and/or buses can be used with a plurality of memories and processors, if desired. Similarly, a plurality of electronic devices can be connected, each providing some of the necessary operations (for example, as a server array, a group of blade servers, or a multiprocessor system). One processor 501 is taken as an example in FIG. 5.

The memory 502 is a non-transitory computer-readable storage medium according to the present disclosure. The memory stores instructions executable by at least one processor, so that the at least one processor executes the traffic scheme control method according to the present disclosure. The non-transitory computer-readable storage medium of the present disclosure stores computer instructions, which are used to cause a computer to execute the traffic scheme control method according to the present disclosure.

As a non-transitory computer-readable storage medium, the memory 502 is configured to store non-transitory software programs, non-transitory computer executable programs and modules, such as program instructions/modules corresponding to the traffic scheme control method in the embodiment of the present disclosure (For example, the first obtaining module 10, the second obtaining module 20, the third obtaining module 30, the determining module 40, and the controlling module 50 shown in FIG. 4). The processor 501 executes various functional applications and data processing of the server by running non-transitory software programs, instructions, and modules stored in the memory 502, that is, implementing the traffic scheme control method in the foregoing method embodiment.

The memory 502 may include a storage program area and a storage data area, where the storage program area may store an operating system and application programs required for at least one function. The storage data area may store data created according to the use of the electronic device, and the like. In addition, the memory 502 may include a high-speed random access memory, and a non-transitory memory, such as at least one magnetic disk storage device, a flash memory device, or other non-transitory solid-state storage device. In some embodiments, the memory 502 may optionally include a memory remotely disposed with respect to the processor 501, and these remote memories may be connected to the electronic device through a network. Examples of the above network include, but are not limited to, the Internet, an intranet, a local area network, a mobile communication network, and combinations thereof.

The electronic device for performing the traffic scheme control method may further include an input device 503 and an output device 504. The processor 501, the memory 502, the input device 503, and the output device 504 may be connected through a bus or in other manners. In FIG. 5, the connection through the bus is taken as an example.

The input device 503 may receive inputted numeric or character information, and generate key signal inputs related to user settings and function control of an electronic device, such as a touch screen, a keypad, a mouse, a trackpad, a touchpad, an indication rod, one or more mouse buttons, trackballs, joysticks and other input devices. The output device 504 may include a display device, an auxiliary lighting device (for example, an LED), a haptic feedback device (for example, a vibration motor), and the like. The display device may include, but is not limited to, a liquid crystal display (LCD), a light emitting diode (LED) display, and a plasma display. In some embodiments, the display device may be a touch screen.

Various embodiments of the systems and technologies described herein may be implemented in digital electronic circuit systems, integrated circuit systems, application specific integrated circuits (ASICs), computer hardware, firmware, software, and/or combinations thereof. These various embodiments may be implemented in one or more computer programs, which may be executed and/or interpreted on a programmable system including at least one programmable processor. The programmable processor may be dedicated or general purpose programmable processor that receives data and instructions from a storage system, at least one input device, and at least one output device, and transmits the data and instructions to the storage system, the at least one input device, and the at least one output device.

These computing programs (also known as programs, software, software applications, or codes) include machine instructions of a programmable processor and may utilize high-level processes and/or object-oriented programming languages, and/or assembly/machine languages to implement these calculation procedures. As used herein, the terms "machine-readable medium" and "computer-readable medium" refer to any computer program product, device, and/or apparatus used to provide machine instructions and/or data to a programmable processor (for example, magnetic disks, optical disks, memories, programmable logic devices (PLDs), including machine-readable media that receive machine instructions as machine-readable signals. The term "machine-readable signal" refers to any signal used to provide machine instructions and/or data to a programmable processor.

In order to provide interaction with a user, the systems and techniques described herein may be implemented on a computer having a display device (e.g., a Cathode Ray Tube (CRT) or a Liquid Crystal Display (LCD) monitor) for displaying information to a user; and a keyboard and pointing device (such as a mouse or trackball) through which the user can provide input to the computer. Other kinds of devices may also be used to provide interaction with the user. For example, the feedback provided to the user may be any form of sensory feedback (e.g., visual feedback, auditory feedback, or haptic feedback), and the input from the user may be received in any form (including acoustic input, voice input, or tactile input).

The systems and technologies described herein can be implemented in a computing system that includes background components (for example, a data server), or a computing system that includes middleware components (for example, an application server), or a computing system that includes front-end components (for example, a user computer with a graphical user interface or a web browser, through which the user can interact with the implementation of the systems and technologies described herein), or include any combination of such background components, intermediate computing components, or front-end components. The components of the system may be interconnected by any form or medium of digital data communication (e.g., a communication network). Examples of communication networks include: local area network (LAN), wide area network (WAN), and the Internet.

The computer system may include a client and a server. The client and server are generally remote from each other and interacting through a communication network. The client-server relation is generated by computer programs running on the respective computers and having a client-server relation with each other.

It should be understood that the various forms of processes shown above can be reordered, added, or deleted. For example, the steps described in this application can be executed in parallel, sequentially, or in different orders, as long as the desired results of the technical solutions disclosed in this application can be achieved, which is not limited herein.

The foregoing specific implementations do not constitute a limitation on the protection scope of the present application. It should be understood by those skilled in the art that various modifications, combinations, sub-combinations, and substitutions may be made according to design requirements and other factors. Any modification, equivalent replacement and improvement made within the spirit and principle of this application shall be included in the protection scope of this application.

What is claimed is:

1. A traffic scheme control method, comprising:

obtaining green light waste time of each lane in each flow direction at a traffic intersection during a green light time period;

obtaining a class saturation of each lane according to the green light waste time of each lane and the green light time period of a corresponding flow direction, and obtaining a class saturation of each flow direction according to the class saturation of each lane;

obtaining a class saturation of each group of flow directions in a current control scheme of a signal controller according to the class saturation of each flow direction, and obtaining a class saturation of the current control scheme according to the class saturation of each group of flow directions in the current control scheme;

determining a class saturation of each candidate control scheme according to the class saturation of each group of flow directions, a green light time period of each group of flow directions in a plurality of candidate control schemes pre-stored in the signal controller, and a green light time period of each group of flow directions in the current control scheme; and determining a target control scheme having a minimum class saturation according to the class saturation of each candidate control scheme, and comparing the class saturation of the current control scheme with the minimum class saturation, in a case of the class saturation of the current control scheme being greater than the minimum class saturation, controlling the signal controller to control a next traffic cycle at the traffic intersection according to the target control scheme.

2. The method according to claim 1, after comparing the class saturation of the current control scheme with the minimum class saturation, further comprising:

in a case of the class saturation of the current control scheme being less than or equal to the minimum class saturation, controlling the signal controller to control the next traffic cycle at the traffic intersection according to the current control scheme.

3. The method according to claim 1, wherein obtaining the green light waste time of each lane in each flow direction at the traffic intersection during the green light time period comprises:

for each vehicle, determining a first time difference between a time point when rear of the vehicle passes a stop line and a time point when front of a following vehicle passes the stop line during the green light time period;

determining a second time difference between each first time difference and a preset time slot;

determining a third time difference between a time point when rear of a last vehicle passes the stop line and an end of the green light time period; and obtaining the green light waste time of each lane by summing the respective second time differences and the third time difference.

4. The method according to claim 3, before determining the second time difference between each first time difference and the preset time slot, further comprising:

identifying a vehicle type group of the first vehicle and the second vehicle; and obtaining the preset time slot corresponding to the vehicle type group.

5. The method according to claim 1, wherein, determining the class saturation of each candidate control scheme according to the class saturation of each group of flow directions, the green light time period of each group of flow directions in the plurality of candidate control schemes pre-stored in the signal controller, and the green light time period of each group of flow directions in the current control scheme, comprises:

determining a ratio of the green light time period of each group of flow directions in each candidate control scheme to the green light time period of each group of flow directions in the current control scheme;

obtaining the class saturation of each group of flow directions in each candidate control scheme by calculating a product of the ratio and a class saturation of a corresponding group of flow directions; and selecting a maximum value from the class saturations of respective groups of flow directions in each candidate control scheme as the class saturation of each candidate control scheme.

6. An electronic device, comprising:

at least one processor; and a memory connected in communication with the at least one processor; wherein, the memory has instructions executable by the at least one processor stored thereon, in a case of the instructions being executed by the at least one processor, causing the at least one processor to implement a traffic scheme control method, the method comprising:

obtaining green light waste time of each lane in each flow direction at a traffic intersection during a green light time period;

obtaining a class saturation of each lane according to the green light waste time of each lane and the green light time period of a corresponding flow direction, and obtaining a class saturation of each flow direction according to the class saturation of each lane;

obtaining a class saturation of each group of flow directions in a current control scheme of a signal controller according to the class saturation of each flow direction, and obtaining a class saturation of the current control scheme according to the class saturation of each group of flow directions in the current control scheme;

determining a class saturation of each candidate control scheme according to the class saturation of each group of flow directions, a green light time period of each group of flow directions in a plurality of candidate control schemes pre-stored in the signal controller, and a green light time period of each group of flow directions in the current control scheme; and determining a target control scheme having a minimum class saturation according to the class saturation of each candidate control scheme, and comparing the class saturation of the current control scheme with the minimum class saturation, in a case of the class saturation of the current control scheme being greater than the minimum class saturation, controlling the signal controller to control a next traffic cycle at the traffic intersection according to the target control scheme.

7. The electronic device according to claim 6, wherein, after comparing the class saturation of the current control scheme with the minimum class saturation, the method further comprises:

in a case of the class saturation of the current control scheme being less than or equal to the minimum class saturation, controlling the signal controller to control the next traffic cycle at the traffic intersection according to the current control scheme.

8. The electronic device according to claim 6, wherein obtaining the green light waste time of each lane in each flow direction at the traffic intersection during the green light time period comprises:

for each vehicle, determining a first time difference between a time point when rear of the vehicle passes a stop line and a time point when front of a following vehicle passes the stop line during the green light time period;

determining a second time difference between each first time difference and a preset time slot;

determining a third time difference between a time point when rear of a last vehicle passes the stop line and an end of the green light time period; and obtaining the green light waste time of each lane by summing the respective second time differences and the third time difference.

9. The electronic device according to claim 8, wherein, before determining the second time difference between each first time difference and the preset time slot, the method further comprises:

identifying a vehicle type group of the first vehicle and the second vehicle; and obtaining the preset time slot corresponding to the vehicle type group.

10. The electronic device according to claim 6, wherein, determining the class saturation of each candidate control scheme according to the class saturation of each group of flow directions, the green light time period of each group of flow directions in the plurality of candidate control schemes pre-stored in the signal controller, and the green light time period of each group of flow directions in the current control scheme, comprises:

determining a ratio of the green light time period of each group of flow directions in each candidate control scheme to the green light time period of each group of flow directions in the current control scheme;

obtaining the class saturation of each group of flow directions in each candidate control scheme by calculating a product of the ratio and a class saturation of a corresponding group of flow directions; and selecting a maximum value from the class saturations of respective groups of flow directions in each candidate control scheme as the class saturation of each candidate control scheme.

11. A non-transitory computer-readable storage medium having computer instructions stored thereon, wherein in a case of the computer instructions being executed, the computer is caused to implement a traffic scheme control method, the method comprising:

obtaining green light waste time of each lane in each flow direction at a traffic intersection during a green light time period;

obtaining a class saturation of each lane according to the green light waste time of each lane and the green light time period of a corresponding flow direction, and obtaining a class saturation of each flow direction according to the class saturation of each lane;

obtaining a class saturation of each group of flow directions in a current control scheme of a signal controller according to the class saturation of each flow direction, and obtaining a class saturation of the current control scheme according to the class saturation of each group of flow directions in the current control scheme;

determining a class saturation of each candidate control scheme according to the class saturation of each group of flow directions, a green light time period of each group of flow directions in a plurality of candidate control schemes pre-stored in the signal controller, and a green light time period of each group of flow directions in the current control scheme; and determining a target control scheme having a minimum class saturation according to the class saturation of each candidate control scheme, and comparing the class saturation of the current control scheme with the minimum class saturation, in a case of the class saturation of the current control scheme being greater than the minimum class saturation, controlling the signal controller to control a next traffic cycle at the traffic intersection according to the target control scheme.

12. The non-transitory storage medium according to claim 11, after comparing the class saturation of the current control scheme with the minimum class saturation, further comprising:

in a case of the class saturation of the current control scheme being less than or equal to the minimum class saturation, controlling the signal controller to control the next traffic cycle at the traffic intersection according to the current control scheme.

13. The non-transitory storage medium according to claim 11, wherein obtaining the green light waste time of each lane in each flow direction at the traffic intersection during the green light time period comprises:

for each vehicle, determining a first time difference between a time point when rear of the vehicle passes a stop line and a time point when front of a following vehicle passes the stop line during the green light time period;

determining a second time difference between each first time difference and a preset time slot;

determining a third time difference between a time point when rear of a last vehicle passes the stop line and an end of the green light time period; and obtain the green light waste time of each lane by summing the respective second time differences and the third time difference.

14. The non-transitory storage medium according to claim 13, before determining the second time difference between each first time difference and the preset time slot, further comprising:

identifying a vehicle type group of the first vehicle and the second vehicle; and obtaining the preset time slot corresponding to the vehicle type group.

15. The non-transitory storage medium according to claim 11, wherein, determining the class saturation of each candidate control scheme according to the class saturation of each group of flow directions, the green light time period of each group of flow directions in the plurality of candidate control schemes pre-stored in the signal controller, and the green light time period of each group of flow directions in the current control scheme, comprises:

determining a ratio of the green light time period of each group of flow directions in each candidate control scheme to the green light time period of each group of flow directions in the current control scheme;

obtaining the class saturation of each group of flow directions in each candidate control scheme by calculating a product of the ratio and a class saturation of a corresponding group of flow directions; and selecting a maximum value from the class saturations of respective groups of flow directions in each candidate control scheme as the class saturation of each candidate control scheme.

* * * * *